US006634298B1

(12) United States Patent
Denney

(10) Patent No.: US 6,634,298 B1
(45) Date of Patent: Oct. 21, 2003

(54) FIRESET FOR A LOW ENERGY EXPLODING FOIL INITIATOR: SCR DRIVEN MOSFET SWITCH

(75) Inventor: Jim R. Denney, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 554 days.

(21) Appl. No.: 09/226,630

(22) Filed: Dec. 21, 1998

(51) Int. Cl.[7] ..... F42D 1/45

(52) U.S. Cl. ..... 102/206; 102/218; 102/220; 102/215

(58) Field of Search ..... 102/218, 220, 102/206, 215

(56) References Cited

U.S. PATENT DOCUMENTS

| | | | | | |
|---|---|---|---|---|---|
| 3,750,586 | A | * | 8/1973 | Swallow et al. | 102/16 |
| 4,012,671 | A | * | 3/1977 | Vaice | 361/249 |
| 4,041,865 | A | * | 8/1977 | Evans et al. | 102/20 |
| 4,227,462 | A | * | 10/1980 | Tucker | 102/220 |
| 5,173,570 | A | * | 12/1992 | Braun | 102/347 |
| 5,218,574 | A | * | 6/1993 | Peregrim | 367/136 |
| 5,507,230 | A | * | 4/1996 | Lewis et al. | 102/218 |
| 5,886,287 | A | * | 3/1999 | Will et al. | 102/220 |

OTHER PUBLICATIONS

Angelo, Jr, James E.. Electronics: BJTs, FETs, and MICRO-CIRCUITS, McGraw–Hill, Inc., 1969.*

* cited by examiner

*Primary Examiner*—Michael J. Carone
*Assistant Examiner*—L. Semunegus
(74) *Attorney, Agent, or Firm*—Laura R. Foster; Earl H. Baugher, Jr.; Gregory M. Bokar

(57) ABSTRACT

A fireset for a low energy exploding foil initiator (LEEFI) comprises a first capacitor for storing a level of electrical energy sufficient to fire the LEEFI, the first capacitor being in electrical communication with the LEEFI, second and third capacitors in electrical communication with the first capacitor for storing lesser levels of energy than is stored by the first capacitor, a diode in electrical communication with the capacitors for limiting charging of the second and third capacitors, and first and second resistors providing isolation among the capacitors. A trigger directs a pulse of electrical energy to a high speed switching transistor adapted to receive the pulse from the trigger and, in response there to, to dump the third capacitor. The third capacitor dumps through a silicone controlled rectifier to short the second capacitor to ground, to decrease the level of energy stored by the second capacitor. A metal oxide semi-conductor field effect transistor (MOSFET) is adapted to be turned on by energy from the second capacitor. The second capacitor discharges into a gate portion of the second MOSFET to turn on the second MOSFET and thereby dump the first capacitor to fire the LEEFI.

8 Claims, 1 Drawing Sheet

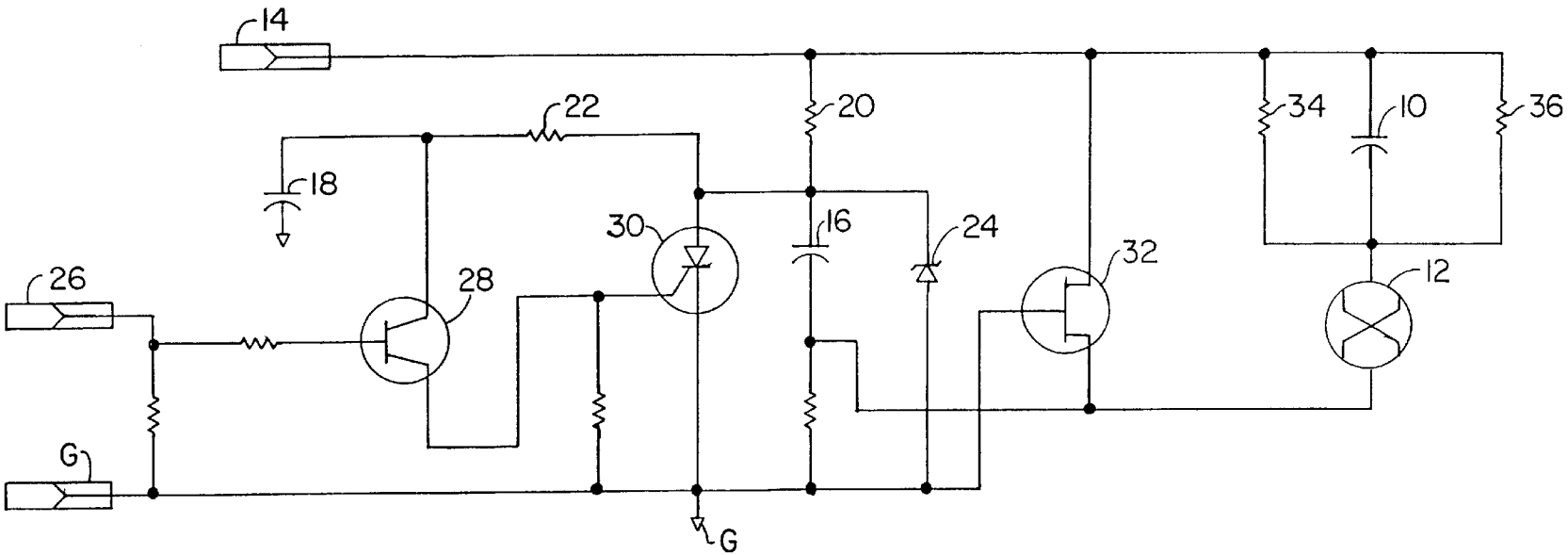
36
10
12
34
32
24
20
16
G
30
22
28
18
14
26
G

FIRESET FOR A LOW ENERGY EXPLODING FOIL INITIATOR: SCR DRIVEN MOSFET SWITCH

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The invention relates to exploding foil initiator (EFI) systems for munitions and is directed more particularly to a low energy exploding foil initiator (LEEFI) system.

2. Description of the Prior Art

Exploding foil initiators (EFIs) are activated by a high current pulse exhibiting an extremely short rise time. The pulse is generated by discharging a high voltage capacitor through a spark gap switch. Spark gap switches have suffered from problems relative to manufacturing, reliability in operation, and high costs. A new LEEFI has been developed which operates at substantially lower energy levels than conventional EFIs. The new LEEFI has the potential to reduce size and cost of foil initiator systems by reducing the size of the high voltage capacitor and charging circuitry.

Spark gap switches are deemed to be less than optimal for LEEFI firesets. The reliability of the spark gap switches is reduced at voltages of less than 1500 V and therefore do not allow for full advantage of savings that could be derived from LEEFI operations which require 1000 V, or less. Further, spark gap switches are reliable only for a limited number of discharges. Accordingly, during and after manufacture, the number of tests performed on each switch must be tracked to ensure that overtest does not degrade performance in a weapon.

Accordingly, there is a need for a new switch, or fireset, for LEEFIs.

SUMMARY OF THE INVENTION

It is, therefore, an object of the invention to provide a fireset for use in conjunction with a LEEFI.

With the above and other objects in view, as will hereinafter appear, a feature of the present invention is the provision of a fireset for a LEEFI, the fireset comprising a first capacitor for storing a level of electrical energy sufficient to fire the LEEFI, the first capacitor being in electrical communication with the LEEFI, second, and third capacitors in electrical communication with the first capacitor for storing lesser levels of energy than is stored by the first capacitor, a diode in electrical communication with the capacitors for limiting charging of the second and third capacitors, and first and second resistors providing isolation among the capacitors. A trigger directs a pulse of electrical energy to a high speed switching transistor to dump the third capacitor. The third capacitor dumps through a silicon controlled rectifier (SCR) to short the second capacitor to ground, to decrease the level of energy stored by the second capacitor. The second capacitor discharges into a gate portion of a Metal Oxide Semi-conductor Field Effect Transistor MOSFET to turn on the second MOSFET and thereby dump the first capacitor to fire the LEEFI.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, and wherein:

The drawing is a schematic diagram of a fireset in combination with a LEEFI, illustrative of an embodiment of the invention.

DESCRIPTION OF THE PREFERRED EMBODIMENT

Referring to the drawing, it will be seen that an illustrative embodiment of the inventive fireset includes a first capacitor 10 for storing a level of electrical energy sufficient to fire a LEEFI 12, which is in electrical communication with the first capacitor 10. The first capacitor 10 is a 0.2 uf low impedance capacitor capable of being charged to 1000 V from a 1000 V DC source 14.

In circuit with the first capacitor 10 are second and third capacitors 16, 18 for storing about 68 V. The capacitors 16, 18 are charged through resistors 20, 22 and are protected from overcharging by a Zener diode 24. The resistors 20, 22 also provide isolation among the capacitors 10, 16, and 18.

In circuit with the aforementioned components is a trigger 26 for directing a pulse of electrical energy to a high speed switching transistor 28, which is adapted to receive and be turned on by the pulse from the trigger 26 and which dumps the third capacitor 18.

A silicon controlled rectifier (SCR) 30 includes a gate portion through which the third capacitor 18 dumps, to short a first side of the second capacitor 16 to ground G, to decrease the level of energy stored by the second capacitor 16, dropping the charge on the second capacitor 16 to −68 V.

The second capacitor 16 discharges into a gate of a MOSFET 32, which is a 1000 V power MOSFET, turning on the MOSFET 32 which dumps the first capacitor 10, firing the LEEFI 12. The very short pulse generated by the SCR 30 (about 19 nsec) provides a 10.78 amp current which drives the MOSFET 32 into avalanche.

Bleed down resistors 34, 36 are provided to discharge. the first capacitor 10 after the charging voltage is removed. This permits the dissipation of firing energy if the LEEFI 12 is not fired, a required safety provision.

Life cycle tests have shown that after hundreds of firings there is no substantial degradation of the system.

There is thus provided a fireset for LEEFIs which is reliable in operation, relatively easy and inexpensive to manufacture, and which can be used with a 1000 V source, rather than the customary 1500 V source required for spark gap switches.

It will be understood that many changes in the details, materials and arrangement of parts, which have been herein described and illustrated in order to explain the nature of the invention, may be made by those skilled in the art within the principles and scope of the invention as expressed in the appended claims.

What is claimed is:

1. A fireset for a low energy exploding foil initiator (LEEFI), the fireset comprising:

a first capacitor for storing a level of electrical energy sufficient to fire the LEEFI, said first capacitor being in electrical communication with the LEEFI;

second and third capacitors in electrical communication with said first capacitor for storing lesser levels of energy than is stored by said first capacitor;

a diode in electrical communication with said capacitors for limiting charging of said second and third capacitors;

first and second resistors providing isolation among said capacitors;

a trigger for directing a pulse of electrical energy;

a high speed switching transistor adapted to receive said pulse of energy from said trigger, to dump said third capacitor;

a silicon controlled rectifier (SCR) having a gate portion through which said third capacitor dumps, to short a first side of said second capacitor to ground, to decrease the level of energy stored by said second capacitor; and a metal oxide semi-conductor field effect transistor (MOSFET) in electrical communication with said second capacitor and adapted to be turned on by energy from said second capacitor;

wherein said second capacitor discharges into a gate portion of said MOSFET to turn on said MOSFET and dump said first capacitor, thereby to fire the LEEFI.

2. The fireset in accordance with claim 1 wherein said first capacitor may be charged to about 1000 V.

3. The fireset in accordance with claim 2 wherein said second and third capacitors may be charged to about 68 V.

4. The fireset in accordance with claim 3 wherein said second and third capacitors are protected from overcharging by a Zener diode.

5. The fireset in accordance with claim 2 wherein resistors provide isolation among said first, second, and third capacitors.

6. The fireset in accordance with claim 2 wherein said MOSFET is a 1000 V power MOSFET.

7. The fireset in accordance with claim 2 wherein said SCR is adapted to generate a pulse of about 10.78 amps for about 19 nsec.

8. The fireset in accordance with claim 1 and further comprising bleed down resistors in communication with said first capacitor to discharge said first capacitor after a charging voltage is removed, to permit dissipation of firing energy if the LEEFI is not fired.

* * * * *